US005374321A

United States Patent [19]

Gatenby et al.

[11] Patent Number: 5,374,321

[45] Date of Patent: Dec. 20, 1994

[54] COLD ROLLING FOR ALUMINUM-LITHIUM ALLOYS

[75] Inventors: Kevin M. Gatenby, Kings Sutton; Ian G. Palmer, Banbury; Roger Grimes, Halton, all of United Kingdom

[73] Assignee: Alcan International Limited, Montreal, Canada

[21] Appl. No.: 169,548

[22] Filed: Dec. 20, 1993

Related U.S. Application Data

[63] Continuation of Ser. No. 859,378, filed as PCT/GB90/01851, Nov. 28, 1990, abandoned.

[30] Foreign Application Priority Data

Nov. 28, 1989 [GB] United Kingdom ..... 8926861.9

[51] Int. Cl.[5] ..... C22F 1/04

[52] U.S. Cl. ..... 148/552; 148/692; 148/693; 148/696; 148/418; 148/439

[58] Field of Search ..... 148/552, 692, 693, 696, 148/418, 439

[56] References Cited

U.S. PATENT DOCUMENTS

| | | | |
|---|---|---|---|
| 4,647,318 | 3/1987 | Foreman | 148/698 |
| 4,652,314 | 3/1987 | Meyer | 148/552 |
| 4,894,096 | 1/1990 | Meyer | 148/552 |

FOREIGN PATENT DOCUMENTS

| | | |
|---|---|---|
| 0157711 | 10/1985 | European Pat. Off. . |
| 0210112 | 1/1987 | European Pat. Off. . |
| 0394155 | 10/1990 | European Pat. Off. . |
| 0282421 | 5/1992 | European Pat. Off. . |
| 2137656 | 10/1984 | United Kingdom . |

OTHER PUBLICATIONS

K. M. Gatenby; (A Thesis); The Development of Microstructure, Texture and Mechanical Properties During The Production Of Aluminum-Lithium Alloys; Sep. 1988.

Journal De Physique, Colloque C3, supplement au No. 9, Tome 48, Sep. 1987, Proceedings of the Fourth International Aluminium-Lithium Conference, Paris, 10-12 Jun. 1987, editions de Physique, (Paris, FR), M. Goncalves et al.: "Static recrystallization after hot working of Al-Li alloys". See pp. C3-171 to C3-177.

*Primary Examiner*—Richard O. Dean
*Assistant Examiner*—Robert R. Koehler
*Attorney, Agent, or Firm*—Browdy and Neimark

[57] ABSTRACT

This invention relates to aluminium alloys containing lithium which are particularly suitable for aerospace construction in that they possess improved cold rolling characteristics optionally with improved damage tolerance. A method of producing sheet or strip material is described which comprises the steps of: (a) providing, in a condition suitable for hot rolling, a billet of an alloy of the composition in weight percent: lithium 1.9 to 2.6; magnesium 0.4 to 1.4; copper 1.0 to 2,2; manganese 9 to 0.09; zirconium 0 to 0.25; at least one other grain-controlling element 0 to 0.5; nickel 0 to 0.5; zinc 0 to 0.5; aluminium balance (except for incidental impurities), wherein the other grain-controlling elements are selected from hafanium, niobium, scandium, cerium, chromium, titanium and vanadium, and wherein at least one of (i) manganese, (ii) zirconium and (iii) one of the said other grain controlling elements is present, (b) hot rolling the billet to produce an intermediate shape suitable for annealing, (c) annealing the said intermediate shape at a temperature sufficiently high for the intermediate shape to be softened sufficiently to be subsequently rolled, and high enough for essentially no δ′ precipitate to be formed, but not so high as to form any significant amount of C phase, and for a time sufficient to precipitate any soluble constituents therein to an extent sufficient to decrease significantly the extent of work hardening needed in step (d), (d) cold rolling the annealed intermediate shape to an extent sufficient to cause an essentially fully recrystallised grain structure to be formed therein during step (e) and to produce a (Abstract continued on next page.)

sheet or strip of the desired thickness, and (c) rapidly heating and rapidly cooling the cold rolled sheet or strip material to produce an essentially fully recrystallised grain structure therein. The preferred temperature range for the annealing step (c) is from 270° C. to 350° C.

21 Claims, 1 Drawing Sheet

COLD ROLLING FOR ALUMINUM-LITHIUM ALLOYS

This application is a continuation of application Ser. No. 07/859,378, filed May 27, 1992 abandoned.

This invention relates to aluminium alloys containing lithium which are particularly suitable for aerospace construction and have been found to have improved cold rolling characteristics.

Such alloys are attractive in providing significant weight reduction, for example of up to 20%, over other aluminium alloys, and it is known that they can present high strength and stiffness and have good corrosion resistance properties. However, they have, in the past, in comparison with other aircraft alloys been liable to suffer from a reduction in fracture toughness and can be difficult to cold roll.

Working with small additions of magnesium, copper and zirconium, one successful aluminium-lithium alloy which has been developed commercially is that designated "8090" and described and claimed in EP-B-0088511. This known alloy has the following composition in weight percent:

| | |
|---|---|
| lithium | 2.0 to 2.8 |
| magnesium | 0.4 to 1.0 |
| copper | 1.0 to 1.5 |
| zirconium | up to 0.2 |
| manganese | 0 to 0.5 |
| nickel | 0 to 0.5 |
| chromium | 0 to 0.5 |
| aluminium | balance (except for incidental impurities) |

This known alloy when measured against previous Al-Li alloys, such as X2020, demonstrates improved fracture toughness whilst not losing other desirable features such as adequate strength.

In EP-B-0088511, the importance of zirconium in controlling grain size and grain growth on recrystallisation is recognised, and the processing of an alloy ingot through the stages of homogenisation, hot working, cold rolling with inter-stage annealing, solution treatment, water quench and stretching is described.

EP-B-0124286 is concerned with an alloy closely similar to the 8090 alloy, except that the copper content thereof has been increased above that described in EP-B-0088511 to at least 1.6% by weight. This alloy is now recognised commercially as "8091". In this patent, the thermal history of the ingot is recognised as having an important bearing upon the isotropy of the final cold rolled sheet or strip, and also upon the ease with which subsequent cold rolling can be performed. Specifically, it is taught in that patent that the cast alloy should be homogenised, hot rolled, cold rolled, solution treated, cold water quenched, and then cold worked, e.g. by stretching.

It has now been found that by using appropriate processing and heat treatment conditions it is possible to produce a sheet or strip material from Al-Li alloys having improved cold rolling characteristics optionally with improved damage tolerance coupled with adequate strength for aerospace construction.

Since "damage tolerance" does not have a precise definition, a set of typical values for the aluminium alloys of the present invention are:

| Tensile properties: | |
|---|---|
| 0.2% Proof strength | >290 MPa |
| Tensile strength | >400 MPa |
| Elongation to fracture | >10% |

Fracture toughness (Kc) measured according to ASTM 561:
For a 1.6 mm thick sheet:

| | Panel Width | | |
|---|---|---|---|
| | 760 mm | 500 mm | 400 mm |
| L-T orientation | >105 MPa√m | >90 Mpa√m | >85 MPa√m |
| T-L orientation | >95 MPa√m | >80 Mpa√m | >75 MPa√m |

Fatigue crack growth:

| | |
|---|---|
| For a 1.6 mm thick sheet da/dn mm/cycle | $<0.7 \times 10^{-4}$ |

(Stress intensity factor range = 10 MPa√m: stress ratio = 0.1)

With regard to fatigue crack growth, in a test of damage tolerance which is applicable to pressurised fuselage structures, a sample of sheet is subjected to a cyclic tensile stress to cause a fatigue crack to grow. The fatigue crack propagates approximately perpendicular to the axis of the tensile load and continues to grow in this direction until failure occurs. In a sheet of an Al-Li alloy the fatigue crack tends to deviate from the perpendicular direction to grow in a direction closer to parallel to the tensile axis, unless the alloy's composition and the sheet's production history have been suitably controlled.

In EP-A-0210112 there is disclosed a product with an Al base containing (in weight) from 1 to 3-5% Li, up to 4% Cu, up to 5% Mg, upto 3% Zn and additions of Mn, Cr and/or Zr characterised in that it contains up to 0.10% Zr, up to 0.8% Mn, up to 0.2% Cr with % Zr/0.03 +% Mn/0.3+Cr/0.07>1, and in that its structure is recrystallised with an average grain size that is less than or equal to 200 μm. There is also disclosed a method of obtaining a recrystallised alloy based on Al and containing (in weight) from 1 to 3.5% Li, up to 4% Cu, up to 5% Mg, up to 3% Zn and additions of Mn, Cr and/or Zr comprising the steps of casting, possibly homogenising, hot rolling and possibly cold rolling with intermediate annealing if necessary, solution heat treating, water quenching, and an under ageing treatment step, characterised in that the percentages of Zr, Mn and Cr are given by the following limits:

Zr≦10%
Mn≦0.8%
Cr≦0.20%
with % Zr/0.03+% Mn/0.3+% Cr/0.07>1.

In this published document there is a specific teaching of an intermediate annealing step at 450° C. and general guidance to use a temperature of from 200° to 500° C. However, it has now been found that within this described range of temperature there occurs a diversity of metallurgical changes that have a profound effect on the behaviour of the metal during subsequent cold rolling and, equally importantly, during recrystallisation after cold rolling.

Similarly in EP-A-0157711 there is disclosed a process for producing products of Al-base alloys essentially containing Li, Mg and Cu as principal alloy elements comprising manufacture, a homogenization operation, a hot rolling operation, optionally a cold rolling operation with intermediate annealing operations if required, a solution treatment, a quenching operation, an optional controlled cold deformation operation and tempering operation charaeterised in that the hot rolling operation is carried out in the range of temperatures of between 100° and 420° C. The purpose of the disclosed method is to obtain a product having a high level of ductility and isotropy. In the method one of the described optional steps is an annealing operation which can be carried out in a temperature range of between 200° and 550° C. and can last for from a few minutes to several hours. In the Examples annealing in a furnace at 350° C. for 1½ hours is mentioned. Again there is no recognition in this publication of the significant effect that annealing at this point in the production route can have on the final product's damage tolerance.

It has now surprisingly been found that there is a very distinct advantage in carrying out this intermediate annealing step within a relatively narrow temperature range, usually between about 270° and 350° C. Annealing within this temperature range results in a fine, substantially uniform precipitate being formed on cooling to room temperature with only relatively small amounts of solute elements retained in solution in the matrix. Material having this metallurgical structure is found, after cold rolling, to recrystallise easily during the final annealing treatment to yield a product with good damage tolerance. It has further been found that the material is amenable to cold rolling.

Al-Li alloy blanks or sheet, subject to conventional annealing treatments, are Drone to edge cracking during cold reductions by cold rolling, or splitting during coiling after cold rolling. In conventional rolling practice on a commercial production mill, these problems are avoided by limiting the cold reduction per pass through the rolling mill to about 15% or less and by carrying out an intermediate anneal after each pass or every second pass through the mill. Substantial savings in production time and production costs could be achieved by increasing the reduction per pass and/or the number of passes between each intermediate anneal. In the course of investigating the improved damage tolerance of aluminum lithium alloys, it has surprisingly been found that there is substantial improvement in the cold rolling behaviour of material annealed under conditions which produce the metallurgical structure described above. Such material is capable of being cold rolled on a commercial mill to reductions of up to 25% or more per pass, and two or more passes may be given between annealing treatments without detrimental edge cracking or splitting occurring.

The lower temperature limit is set by (a) the appearance in the annealed structure of a coarse precipitate designated delta prime (δ') which is found to be detrimental to the subsequent cold rolling behaviour, and (b) the requirement to achieve sufficient softening of the worked alloy for subsequent rolling. A description of δ' can be found in K. Gatenby's Ph.D. Thesis of 1988 from The University of Birmingham, England. For the preferred aluminium-lithium alloys used in the present invention δ' has been found not to appear at temperatures above about 270° C.

Raising the annealing temperature above about 350° C. has been found to cause rapid formation of a coarse, brittle, intermetallic phase. This phase, which is of somewhat variable composition, but which is denoted as "C phase" (see K. Gatenby's Ph.D. Thesis of 1988 from The University of Birmingham, England), has a very detrimental effect on cold rolling behaviour, since it causes cracking of the sheet or strip. The C phase particles are fractured during rolling, thereby creating voids in the structure which are retained after annealing.

Although the C phase is absent from samples annealed at 450° C., it is found that annealing at this high temperature increases the amount of solute element held in solution in the matrix on cooling to room temperature. This results in two detrimental effects:

(a) The work hardening rate during cold rolling is much higher after annealing at 450° C. than it is after annealing at 350° C. For example an 8090 alloy given an intermediate anneal at 350° C. and cold rolled to 65% reduction had a hardness of about 100 VPN, whereas an identical material given the same rolling reduction after an anneal at 450° C. had a hardness of 130 VPN. This higher hardness is reflected in greater roll loads, and hence increased difficulty in rolling, and in a greater tendency to cracking, and (b) Recrystallisation after cold rolling is more difficult to achieve when the intermediate anneal has been carried out at 450° C. An 8090 alloy annealed at 350° C. and cold rolled to 37% reduction in thickness was completely recrystallised after a standard anneal of 10 to 20 minutes at 530° C. in a salt bath. Similar material annealed at 450° C. and rolled to the same reduction showed only slight recrystallisation after annealing at 530° C. and complete recrystallisation was not observed until a 73% cold reduction was employed followed by the standard salt bath anneal.

In accordance with the present invention there is provided a method of producing sheet or strip material of improved cold rolling characteristics optionally with improved damage tolerance which comprises the steps of:

(a) providing, in a condition suitable for hot rolling, a cast billet of an alloy of the composition in weight percent:

| | |
|---|---|
| lithium | 1.9 to 2.6 |
| magnesium | 0.4 to 1.4 |
| copper | 1.0 to 2.2 |
| manganese | 0 to 0.9 |
| zirconium | 0 to 0.25 |
| at least one other grain-controlling element | 0 to 0.5 |
| nickel | 0 to 0.5 |
| zinc | 0 to 0.5 |
| aluminium | balance (except for incidental impurities) |

wherein the other grain-controlling elements are selected from hafnium, niobium, scandium, cerium, chromium, titanium and vanadium, and wherein at least one of (i) manganese, (ii) zirconium and (iii) one of the said other grain controlling elements is present, (b) hot rolling the billet to produce an intermediate shape suitable for annealing, (c) annealing the said intermediate shape at a temperature sufficiently high for the intermediate shape to be softened sufficiently to be subsequently rolled, and high enough for essentially no δ' precipitate to be formed, but not so high as to form any significant amount of C phase, and for a time sufficient to precipitate any soluble constituents therein to an extent sufficient to decrease significantly the extent of work hardening needed in step (d), (d) cold rolling the annealed intermediate shape to an extent sufficient to cause an essentially fully recrystallised grain structure to be formed therein during step (e) and to produce a sheet or strip of the desired thickness, and (e) rapidly heating and rapidly cooling the cold rolled sheet or strip material to produce an essentially fully recrystallised grain structure therein.

Generally the billet is provided in the form of a casting. In order to bring the billet in a condition for hot rolling the following two additional steps are needed:

(1) heating the cast billet to a temperature and for a time sufficient to relieve internal stresses in the billet caused by its cooling and solidification from the molten state, (2) heating the stress-relieved billet to a temperature and at a rate and for a time sufficient to cause essentially all of the low melting point phases in the billet to be dissolved without melting and a homogenised billet to be produced.

The billet can, however, be provided by any other known technique, for example, spray deposition or powder technology. In these cases, the above two optional steps may not be needed.

With some of the alloys used in the present invention, it has been found that they age at room temperature to an extent sufficient to produce a sheet or strip of improved damage tolerance. With other alloys, however, a distinct ageing step is necessary. In either case, ageing can be preceded by a stretching or planishing step if required.

Furthermore, prior to ageing the recrystallised sheet or strip can optionally be recrystallised again, by repeating the above steps starting again from step (c), or possibly from step (d). It has been found that a second recrystallisation is significantly easier to achieve than the first recrystallisation in that the amount of cold rolling required to achieve complete recrystallisation is significantly less (10–20%) as compared with 30–40% for the first recrystallisation. The easier second recrystallisation is probably a result of loss of coherency of the $Al_3Zr$ diapersoid particles which occur as a result of the first recrystallisation, with the incoherent $Al_3Zr$ being less effective in preventing subsequent recrystallisation.

The aluminium-lithium alloys used in the present invention contain magnesium and copper and at least one grain-controlling element in an amount sufficient to produce a dispersion of particles capable of preventing grain coarsening, whilst allowing recrystallisation to occur during the later processing steps. Zirconium is the preferred grain-controlling element, but other elements including hafnium, niobium, scandium, cerium, chromium, manganese, titanium or vanadium or mixtures thereof, may be used with or without zirconium. Generally, zirconium is used in an amount of up to 0.15% by weight, preferably 0.05 to 0.10% and more preferably 0.05 to 0.07%, although the precise amount of zirconium or other grain-refining elements will depend upon the precise casting conditions used, the size of the cast ingot, the particular ingot cooling system used, and upon the subsequent annealing processes. Usually a balance is struck between having a Zr content low enough to allow full recrystallisation to occur during the heat treatment step, which is essential, and a reasonably high Zr content in order to have a useful grain-controlling effect.

Because it has been found that with a lithium content greater than 2.60% by weight the resulting sheet or strip material is difficult to cold roll, preferably values of lithium no higher than 2.5 and down to 2.20% by weight are used, more preferably from 2–25 to 2.45% by weight.

For magnesium, the preferred range is 0.7 to 1.4%, desirably 0.8 to 1.2% by weight, whilst for copper the preferred range is 1.0 to 1.4%, desirably 1.10 to 1.30% by weight.

Although the presence of manganese is beneficial as it both functions as a grain-controlling element and encourages recrystallisation and can be added up to 0.9%, in practice there is a reluctance to add this element because it creates problems in recycling the scrap metal. Since it does provide some grain-controlling effect, however, when present the preferred range for manganese is up to 0.5% by weight.

The remaining content of the alloy is preferably as for AA 8090, but here zinc may be present in amounts up to 0.5% as an intentional addition or as a tramp element arising, for example, as a result of recycling Al-Li alloy products which had been clad with an Al-Zn alloy.

The processing steps for the production of sheet or strip material in accordance with the present invention using an initial casting method are as follows:

1. The alloy is east, preferably by the direct chill method, and then heated at a controlled rate to a temperature sufficient to relieve internal stresses caused by the cooling from melt of the molten alloy. For the preferred alloys described above, this is generally between 300° and 500° C., preferably between 300° and 400° C. During this heating, some precipitation of at least some of the constituents held in super-saturated solid solution may occur.
2. Either with intermediate cooling or following directly on from the heating step 1, the stress-relieved billet is heated at a controlled rate such that the low melting point phases are substantially all dissolved without melting, and the billet homogenised by holding it at a temperature and for a time sufficient to dissolve substantially all of the soluble phases. The billet may then be cooled to room temperature and scalped.
3. The homogenised billet is then reheated generally to between 535° and 545° C. and hot rolled, optionally with re-heating at intermediate stages, and optionally with hot widening, i.e. cross-rolling at elevated temperature, to produce an intermediate shape suitable for annealing. If desired, the hot rolled metal may be heated to about 450° C. in order to allow alteration of the distribution of the second phase particles to occur.
4. The hot rolled material is then annealed in order to precipitate any soluble constituents therein in order to reduce the extent of work hardening during cold rolling. For the preferred alloys described above this is generally performed at between about 270° C. and 350° C., preferably between about 270° and 325° C., and more preferably about 300° C., depending on the precise composition of the alloy used. As discussed above, the annealing temperature should be sufficiently high for the intermediate shape to be softened sufficiently to be subsequently rolled, and high enough for essentially no δ' precipitate to be formed, but not so high as to form any significant amount of C phase.
5. The annealed material is then cold rolled to its final thickness, optionally with inter-annealing usually between 270° and 350° C., such that sufficient cold work is imparted to the sheet or strip to cause a fine re-crystallised grain structure to be formed during solution treatment.

6. The cold-rolled sheet or strip is then rapidly heated to a suitable heat-treatment temperature, preferably in a salt bath, and rapidly cooled, preferably by water quench, in order to produce a solution-treated, fully recrystallised grain structure therein. It should be noted that this heat treatment can be done in two steps, the first step at a lower temperature of from about 450° C. to below about 530° C. in order to bring about recrystallisation and then a second step at about 530° C. followed by water quench to solution treat the sheet or strip. The heating step can be carried out using a continuous heat treatment furnace, an air-recirculating furnace or by induction heating, but a salt bath is preferred.
7. Optionally recrystallisation can be performed again starting again from step 4 or from step 5 as previously discussed.
8. The quenched sheet or strip is then if desired stretched and/or planished and then under aged, for example at about 150° C. for 24 hours, to produce the finished product. Natural ageing may be possible for certain alloys depending on the particular combination of toughness and strength that is desired.

Embodiments of the present invention will now be described by way of example with reference to the following Examples and the accompanying drawing.

BRIEF DESCRIPTION OF THE DRAWING

The FIGURE is a graph showing the energy required to initiate or propagate a crack as a function of overaging temperature.

EXAMPLE 1

Figure 1:
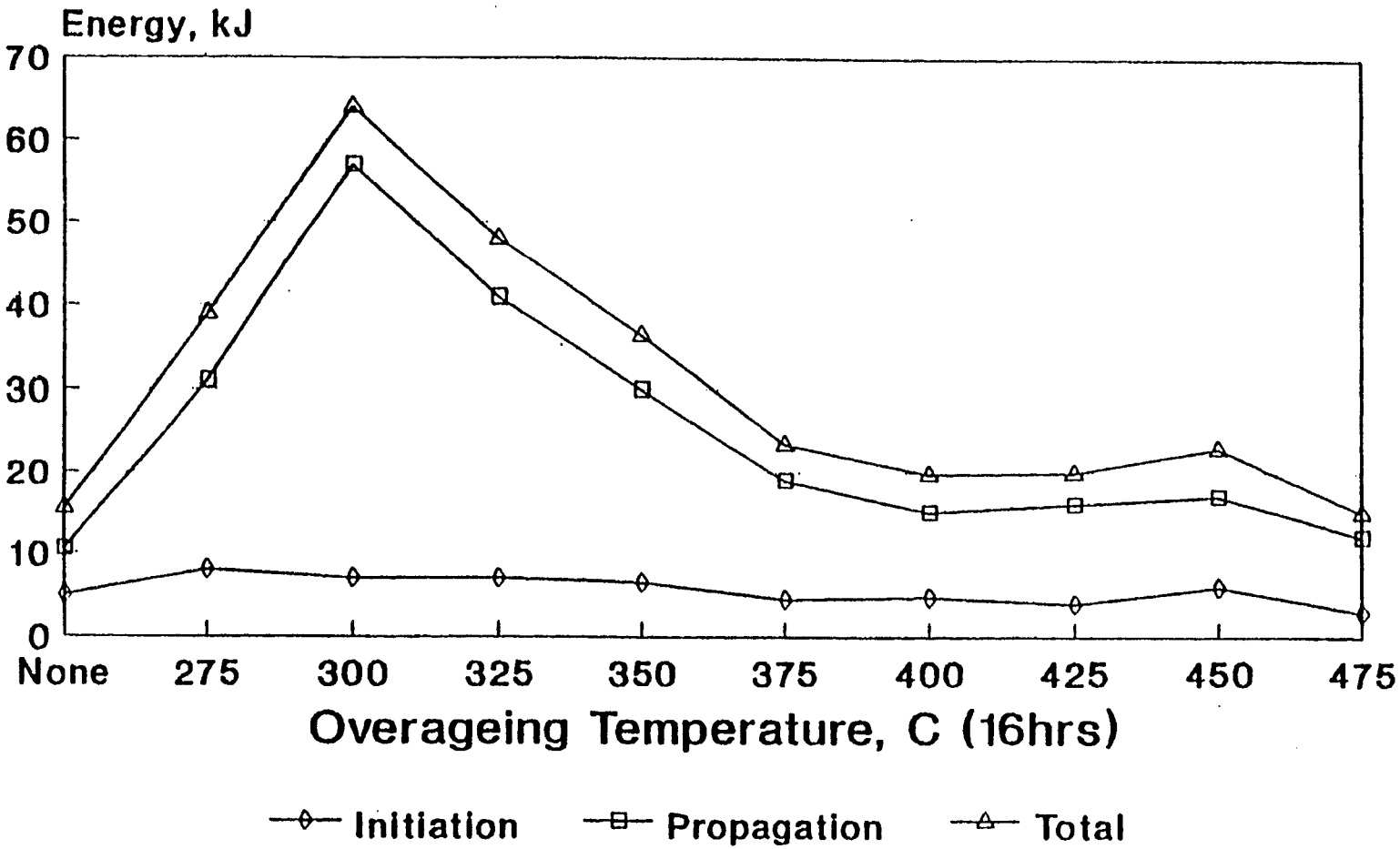

A manganese-containing alloy was made according to the present invention.

An ingot having composition A of Table 1 was cast by direct chill casting and then stress relieved followed by homogenisation at 540° C. The ingot was hot rolled to a blank 4 mm thick and then annealed for 8 hours at 300° C. The blank was then cold rolled to 3.0 mm thick and annealed again at 300° C. for 8 hours. The blank was then cold rolled to 1.6 mm thick and solution treated in a salt bath for 10 minutes at530° C. and water quenched. After planishing and stretching by 2% the strip was aged for 24 hours at 150° C.

The recrystallised grain size, tensile and fracture toughness properties of the sheet are given in Table 2.

This alloy had good mechanical properties but, for the reasons mentioned earlier, it is sometimes preferable to avoid Mn additions. Fatigue properties were found to be superior to a clad 2024 alloy tested under similar conditions.

EXAMPLE 2

An ingot having the composition B in Table 1 was cast and then hot and cold rolled as described in Example 1 above. The grain size and mechanical properties of the finished sheet are given in Table 2.

When fatigue tests were carried out, it was found that the fatigue cracks initially grew in a direction perpendicular to the tensile stress axis but subsequently showed significant deviation, on a macroscopic scale, towards this axis. Whilst this fatigue crack behaviour is unacceptable in certain aircraft structures, such as skinning sheet of large passenger aircraft, it would not be unacceptable in other areas requiring high damage tolerance, e.g. fuselage frames fabricated from sheet material.

EXAMPLE 3

An ingot having the composition C in Table I was processed as in Example 1. The recrystallised grain size and the mechanical properties of the finished sheet are given in Table 2.

When fatigue tests were carried out on this alloy, it was found that the cracks grew perpendicular to the stress axis without macroscopic crack deviation.

TABLE 1

| INGOT | Li | Cu | Mg | Zr | Mn |
|---|---|---|---|---|---|
| A | 2.33 | 1.19 | 0.69 | 0.07 | 0.29 |
| B | 2.44 | 1.27 | 0.73 | 0.06 | — |
| C | 2.27 | 1.18 | 0.83 | 0.07 | — |
| D | 2.32 | 1.14 | 0.85 | 0.07 | — |

TABLE 2

| EXAMPLE | 0.2% PROOF STRENGTH MPa | TENSILE STRENGTH MPa | ELONGATION % | Kc MPa/m L-T[1] | Kc MPa/m T-L[2] | GRAIN SIZE[3] μm |
|---|---|---|---|---|---|---|
| A | L 340 | 438 | 11 | 167 | 117 | 15 |
| | T 308 | 443 | 12 | | | |
| B | L 346 | 443 | 10 | 140 | 106 | 21 |
| | T 309 | 440 | 12 | | | |
| C | L 329 | 421 | 10 | 150 | 111 | 21 |
| | T 293 | 422 | 12 | | | |

Notes:
1 - for a 760 mm wide panel
2 - for a 500 mm wide panel
3 - measured according to ASTM E112

EXAMPLE 4

An ingot having the composition D in Table 1 was processed as in Example 1 except that after cold rolling to a thickness of 1.4 mm, some of the cold rolled sheet was recrystallised in a salt bath for 30 minutes at 530° C. and then cold water quenched to give a fine equiaxed recrystallised grain structure (D1), and some was recrystallised in a pre-heated air recirculating furnace for 30 minutes at 530° C. and then cold water quenched to give a fine lamellar recrystallised grain structure (D2). Both materials were stretched 2% and then aged for different times at 150° C. to give similar proof strength levels. The recrystallised grain size, tensile and fracture toughness properties of the sheets are given in Table 3.

It can be seen that both materials show high levels of fracture toughness. (The toughness values obtained for these 1.4 mm thick materials are slightly lower than those shown in Table 2 for 1.6 mm thick material, as a result of both the decrease in sheet thickness, and the use of a narrower test panel width.)

TABLE 3

| Example | Age (hr/°C.) | PS (MPa) | TS (MPa) | El. (%) | $K_c$*(L-T) (MPa/m) | Grain Size (μm) |
|---|---|---|---|---|---|---|
| D1 | 16/150 | L 325 | 434 | 12.5 | 134 | 18 |
| D2 | 64/150 | L 329 | 419 | 9.0 | 125 | 23 × 40 |

* 400 mm wide panel

EXAMPLE 5

Samples of the salt bath recrystallised material from Example 4 were then cold rolled to a range of reductions including 5% and 12%. The samples were then annealed in a salt bath for 30 minutes at 530° C. On examination of the grain structure, it was found that the sample rolled 5% exhibited excessive secondary grain growth whereas the samples rolled 12% or more showed fine fully recrystallised grain structures.

It has been found that hot rolled blank given an intermediate anneal at about 300° C. will not fully recrystallise during annealing at 530° C. until it has received about 30% cold reduction.

The Example shows that the second recrystallisation can be induced after lower strains than the first recrystallisation.

Although described with reference to the batch treatment of sheets, it will be appreciated that it is possible to carry out the treatments in a continuous heat treatment line. It has been found that a two-step annealing treatment, which could most conveniently be done on a continuous heat treatment line has a surprising effect on the finished sheet as Example 5 shows.

EXAMPLE 6

A cast billet of 8090 standard material was stress relieved, homogenised and reheated to 540° C. before hot rolling to 6 mm thick. Samples of the sheet were then annealed for 16 hours at a temperature between 275° and 475° C. and then cold rolled to 40% reduction in thickness. For comparison, a sample of the as hot rolled material was also cold rolled to 40% reduction in thickness.

Specimens prepared for the Kahn Tear Test (see Alcoa Technical Paper 18 published in 1965 entitled "Fracture Characteristics of Aluminium Alloys" by J. Kaufman and M. Holt) were taken and tested using known procedures to establish the energy required to initiate a crack and the energy required to propagate a crack. A pronounced increase in the crack propagation energy was observed in those samples annealed between 275° and 350° C. as shown in FIG. 1. Above 350° the crack propagation energy decreases eventually falling to a level only slightly above that of the sample cold rolled without the intermediate anneal. These results demonstrate that the optimum temperature for annealing lies between 275° and 350° C. since metal annealed in this temperature range is less likely to crack during subsequent cold deformation.

For the Kahn Tear Test the thickness used was 0.100" (2.54 mm).

EXAMPLE 7

Samples of hot rolled strip of thickness 6.4 mm and composition (wt %) 2.48 Li—1.22 Cu—0.83 Mg—0.069 Zr were annealed at 300° C. and 350° C. for times of 1, 2, 4, 8, 16 and 32 h, respectively, followed by air cooling. For comparison some samples were cooled using slow furnace cooling for annealing times of 1h and 16h. The tensile properties of the samples were determined and are set out in Table 4.

It can be seen that for both annealing temperatures the proof strength and ultimate strength levels decrease and the ductility increases with increased annealing time. Longer annealing times (16 h) therefore result in material which is significantly softer and more ductile than after shorter annealing times (1–2 h), even if the shorter times are followed by slow furnace cooling. The optimum annealing treatment, which produced low strength levels and the highest ductility, was found to be 16 h, at 300° C.

It is noteworthy that these results demonstrate that the lowest strength and highest ductility occurs at a much longer treatment time than those recited in Examples 2 and 3 of EP-A-0157711 Furthermore, the strength and ductility levels are not significantly influenced by the rate of cooling from the annealing temperature.

Whilst it is known that extended annealing times, or higher temperatures, may increase ductility and reduce strength of many alloys, it is surprising that this is observed in this temperature range in the Al-Li alloys of this invention which, on heating, are prone to form intermetallic phases which can adversely affect strength and/or ductility.

TABLE 4

| Annealing Temp. (°C.) | Time (h) | Cooling Method | 0.2% Proof Stress (MPa) | Tensile Strength (MPa) | Elongation (%) |
|---|---|---|---|---|---|
| 300 | 1 | Furnace | 191 | 303 | 9.5 |
| 300 | 1 | Air | 183 | 297 | 9.7 |
| 300 | 2 | Air | 184 | 295 | 10.9 |
| 300 | 4 | Air | 176 | 288 | 9.5 |
| 300 | 8 | Air | 177 | 288 | 10.0 |
| 300 | 16 | Air | 172 | 277 | 12.2 |
| 300 | 16 | Furnace | 176 | 278 | 11.5 |
| 300 | 32 | Air | 169 | 271 | 11.6 |
| 350 | 1 | Furnace | 183 | 292 | 9.9 |
| 350 | 1 | Air | 179 | 293 | 10.7 |
| 350 | 2 | Air | 176 | 286 | 10.4 |
| 350 | 4 | Air | 174 | 281 | 11.0 |
| 350 | 8 | Air | 170 | 273 | 11.4 |
| 350 | 16 | Air | 168 | 259 | 11.1 |
| 350 | 16 | Furnace | 162 | 257 | 10.1 |
| 350 | 32 | Air | 161 | 255 | 11.5 |

What is claimed is:

1. A method of producing sheet or strip material of improved cold rolling characteristics optionally with improved damage tolerance which comprises the steps of:

(a) providing, in a condition suitable for hot rolling, a billet of an alloy of the composition in weight percent:

| | |
|---|---|
| lithium | 1.9 to 2.6 |
| magnesium | 0.4 to 1.4 |
| copper | 1.0 to 2.2 |
| manganese | 0 to 0.9 |
| zirconium | 0 to 0.25 |
| at least one other grain-controlling element | 0 to 0.5 |
| nickel | 0 to 0.5 |
| zinc | 0 to 0.5 |
| aluminium | balance (except for incidental impurities) |

wherein the other grain-controlling elements are selected from the group consisting of hafnium, niobium, scandium, cerium, chromium, titanium and vanadium, and wherein at least one of (i) manganese, (ii) zirconium and (iii) one of the said other grain controlling elements is present, (b) hot rolling the billet to produce an intermediate shape suitable for annealing, (c) annealing the said intermediate shape at a temperature sufficiently high for the intermediate shape to be softened sufficiently to be subsequently rolled, and high enough for essentially no δ' precipitate to be formed, but not so high as to form any significant amount of C phase, and for a time sufficient of at least four hours to precipitate any soluble constituents therein to an extent sufficient to decrease significantly the extent of work hardening needed in step (d), (d) cold rolling the annealed intermediate shape to an extent sufficient to cause an essentially fully recrystallised grain structure to be formed therein during step (e) and to produce a sheet or strip of the desired thickness, and (e) rapidly heating and rapidly cooling the cold rolled sheet or strip material to produce an essentially fully recrystallised grain structure therein.

2. A method as claimed in claim 1 wherein the billet is cast and is provided in a condition for hot rolling by the steps of:

(1) heating the cast billet to a temperature and for a time sufficient to relieve internal stresses in the billet caused by its cooling and solidification from the molten state, (2) heating the stress-relieved billet to a temperature and at a rate and for a time sufficient to cause essentially all of the low melting point phases in the billet to be dissolved without melting and a homogenised billet to be produced.

3. A method as claimed in claim 2 including the step of cooling the stress-relieved billet between steps (1) and (2).

4. A method as claimed in claim 1 wherein the alloy contains lithium in an amount of from 2.25 to 2.45 percent by weight.

5. A method as claimed in claim 1 wherein the alloy contains copper in an amount of from 1.10 to 1.30 percent by weight.

6. A method as claimed in claim 1 wherein the grain-controlling element is zirconium and is present in an amount of from 0.05 to 0.10 percent by weight.

7. A method as claimed in claim 6 wherein the zirconium is present in an amount of from 0.05 to 0.07 percent by weight.

8. A method as claimed in claim 1 wherein the alloy contains magnesium in an amount of from 0.8 to 1.2 percent by weight.

9. A method as claimed in claim 1 wherein the alloy contains manganese in an amount of up to 0.5 percent by weight.

10. A method as claimed in claim 1 wherein the annealing step (c) is carried out at a temperature of from 270° C. to 350° C.

11. A method as claimed in claim 10 wherein the annealing step (c) is carried out at a temperature of from 270° to 325° C.

12. A method as claimed in claim 1 including the steps of re-heating and optionally hot widening the homogenised billet during or subsequent to the hot rolling of the billet in step (b).

13. A method as claimed in claim 1 including at least one inter-annealing step during the cold rolling of the annealed intermediate shape in step (d).

14. A method as claimed in claim 1 wherein the heating of the cold rolled sheet or strip material of step (e) is performed in a salt bath.

15. A method as claimed in claim 1 wherein the cooling of the heated cold rolled sheet or strip material of step (e) is performed using a water quench.

16. A method as claimed in claim 1 wherein the recrystallised sheet or strip material is recrystallised again by performing again after step (e) either step (c) or step (d) and its following steps.

17. A method as claimed in any one of the preceding claim 1 wherein after step (e) the sheet or strip material is stretched and/or planished and then under aged.

18. A method according to claim 4 wherein the alloy contains copper in an amount of from 1.10 to 1.30% by weight, the grain-controlling element is zirconium present in an amount of from 0.05 to 0.07% by weight, the alloy contains magnesium in an amount of from 0.8 to 1.2% by weight, and the alloy contains manganese which is present in an amount of up to 0.5% by weight.

19. A method according to claim 18 wherein the annealing step (c) is carried out at a temperature of from 270° to 325° C.

20. A method according to claim 10, wherein said hot rolling step (b) is carried out at a temperature of at least 535° C.

21. A method of producing sheet or strip material of improved cold rolling characteristics optionally with improved damage tolerance which comprises the steps of:

(a) providing, in a condition suitable for hot rolling, a billet of an alloy of the composition in weight percent:

| | |
|---|---|
| lithium | 1.9 to 2.6 |
| magnesium | 0.4 to 1.4 |
| copper | 1.0 to 2.2 |
| manganese | 0 to 0.9 |
| zirconium | 0 to 0.25 |
| at least one other grain-controlling element | 0 to 0.5 |
| nickel | 0 to 0.5 |
| zinc | 0 to 0.5 |
| aluminum | balance (except for incidental impurities |

wherein the other grain-controlling elements are selected from the group consisting of hafnium, niobium, scandium, cerium, chromium, titanium and vanadium, and wherein at least one of (i) manganese, (ii) zirconium and (iii) one of the said other grain controlling elements is present, (b) hot rolling the billet to produce an intermediate shape suitable for annealing, (c) annealing the said intermediate shape at a temperature sufficiently high for the intermediate shape to be softened sufficiently to be subsequently rolled, and high enough for essentially no δ' precipitate to be formed, but not greater than 325° C. and not so high as to form any significant amount of C phase, and for a time sufficient of at least four hours to precipitate any soluble constituents therein to an extent sufficient to decrease significantly the extent of work hardening needed in step (d), (d) cold rolling the annealed intermediate shape to an extent sufficient to cause an essentially fully recrystallized grain structure to be formed therein during step (e) and to produce a sheet or strip of the desired thickness, and (e) rapidly heating and rapidly cooling the cold rolled sheet or strip material to produce an essentially fully recrystallized grain structure therein.

* * * * *